US005371436A

United States Patent [19]

Griswold et al.

[11] Patent Number: 5,371,436

[45] Date of Patent: Dec. 6, 1994

[54] COMBUSTION IGNITOR

[75] Inventors: James E. Griswold; Ronald P. Corio; Ronald C. Pate, all of Albuquerque, N. Mex.

[73] Assignee: Hensley Plasma Plug Partnership, Albuquerque, N. Mex.

[21] Appl. No.: 459,904

[22] Filed: Jan. 2, 1990

Related U.S. Application Data

[63] Continuation-in-part of Ser. No. 414,054, Sep. 28, 1989, Pat. No. 5,272,415.

[51] Int. Cl.[5] ..... H01T 13/04

[52] U.S. Cl. ..... 315/58; 123/143 B; 123/596; 123/605

[58] Field of Search ..... 315/57, 58, 60; 123/143 A, 143 B, 143 C, 596, 605, 169 R; 313/130, 135, 141, 237

[56] References Cited

U.S. PATENT DOCUMENTS

| | | | |
|---|---|---|---|
| 2,150,727 | 3/1939 | Nowosielski | 313/135 |
| 2,392,171 | 1/1946 | Marsh | 313/135 |
| 2,467,534 | 4/1949 | Osterman | 315/57 |
| 3,683,232 | 8/1972 | Baur | 315/58 |
| 4,123,688 | 10/1978 | Yoshikawa | 315/59 |
| 4,315,298 | 2/1982 | Mulkins et al. | 123/169 R |
| 4,589,398 | 5/1986 | Pate et al. | 123/596 |

FOREIGN PATENT DOCUMENTS

| | | | |
|---|---|---|---|
| 2013989 | 8/1979 | United Kingdom | 313/135 |

*Primary Examiner*—Eugene R. LaRoche
*Assistant Examiner*—Son Dinh
*Attorney, Agent, or Firm*—Dykema Gossett

[57] ABSTRACT

An ignitor (118) comprises a body portion (120) connected with an electrical supply cable (122) and an electrode portion (124) removably mounted within the body portion (120). The body portion (120) includes a capacitor defined by an outer, electrically conductive shell (126) of the body portion, and an inner, tubular capacitor plate (134). The inner, tubular capacitor plate (134) is held within the body portion (120) by means of a connector assembly (132) which is held in place by a dielectric potting compound (136).

29 Claims, 15 Drawing Sheets

COMBUSTION IGNITOR

RELATED APPLICATIONS

This application is a continuation-in-part of U.S. patent application Ser. No. 414,054 filed Sep. 28, 1989, U.S. Pat. No. 5,272,415.

TECHNICAL FIELD

The present invention generally relates to electrically responsive devices for initiating combustion of fuel, and deals more particularly with an ignitor device of the type having electrical capacitance for transferring stored electrical energy to a pair of ignitor discharge electrodes.

BACKGROUND ART

Various types of ignitor devices have been devised in the past for the purpose of initiating combustion of fuel. Others have recognized the importance of transferring a large amount of energy from an energy source to a fuel-air mixture in order to ignite the mixture and thus have resorted to incorporating capacitive elements in the ignitor for this purpose. Ignitor devices of the type described above may be more accurately characterized as conventional spark plugs which are concerned with producing a "hotter" spark. The peak power delivered to the electrical discharge of such devices is relatively low.

More recently, systems have been devised for increasing the efficiency with which electrical discharge energy is coupled to the fuel in order to initiate and promote a more rapid combustion vent and extend the lean operating limit of the fuel mixture. For example, U.S. patent application Ser. No. 701,482, filed Feb. 14, 1985, discloses a system for initiating combustion of fuel, especially for internal combustion engines, which employs a very rapid, intense, high-power electrical breakdown to increase the rate of combustion and thereby reduce the need for advanced engine timing. The use of a driving circuit which has exceptionally low inductance and resistance results in the rapid electrical breakdown and coupling of at least 50 percent of the stored pulse energy to the breakdown channel within the first half period of the discharge current cycle. The resulting discharge effects enhance combustion of the fuel through, among other things, the cooperative effects of photolysis, supersonic hydrodynamic shock waves and high-temperature thermal plasma. The ignitor device employed in the above-referenced system must possess extremely low inductance and resistance and may include means for storing a substantial amount of energy in close proximity to the electrodes of the device so as to quickly transfer this stored energy to the breakdown channel. The combustion ignitor of the present invention meets these requirements and is intended to be employed with such a system, although it is contemplated that the present invention could be used advantageously with other systems as well.

SUMMARY OF THE INVENTION

According to the present invention, a combustion ignitor is provided for use with a combustion initiation system typically employed in connection with an internal combustion engine for initiating combustion of a fuel-air mixture. The ignitor is characterized by exceptionally low inductance and resistance and is provided with capacitive means for storing a substantial amount of energy in close proximity to a pair of ignitor electrodes between which the stored electrical energy is discharged. The ignitor broadly comprises a generally cylindrical body portion adapted to be coupled with a coaxial electrical power supply cable and an electrode portion which may be stationarily or removably secured on the body portion, thereby allowing the electrodes to be replaced if necessary. The capacitive means comprises at least one pair of generally cylindrical, concentric, radially spaced capacitor plates, one of which plates may be defined by an outer shell of the cylindrical body portion, the other plate being held in place within the outer shell by means of a connector assembly and encapsulation material. The outer, electrically conductive shell and capacitor plate is connected to the outer body of the electrode portion by means of an end connector assembly. Any of various means are provided to releasably hold the electrode portion within the body portion, including snap-fit arrangements, threaded terminals and biased key arrangements. Two or more pairs of the capacitor plates may be employed in those applications requiring higher voltages.

It is a primary object of the present invention to provide a combustion ignitor which is exceptionally low in inductance and resistance and is provided with capacitive means for rapidly transferring a large amount of power to the electrodes of the ignitor.

Another object of the invention is to provide an ignitor as described above which is configured to hold off exceptionally high voltages without internal breakdown.

Another object of the invention is to provide an ignitor as described above in which the electrodes can be removed for repair or replacement.

Still another object of the invention is to provide an ignitor as described above which is exceptionally compact in design so as to require a minimum amount of space in an engine compartment while maximizing the quantity of electrical energy which may be stored therein.

These, and further objects of the invention, will be made clear or will become apparent during the course of the following description of a preferred embodiment of the invention.

BRIEF DESCRIPTION OF THE DRAWINGS

In the drawings, which form an integral part of the specification and are to be read in conjunction therewith, and in which like reference numerals are employed to designate identical components in the various views.

DETAILED DESCRIPTION OF THE PREFERRED EMBODIMENTS

Figure 1:
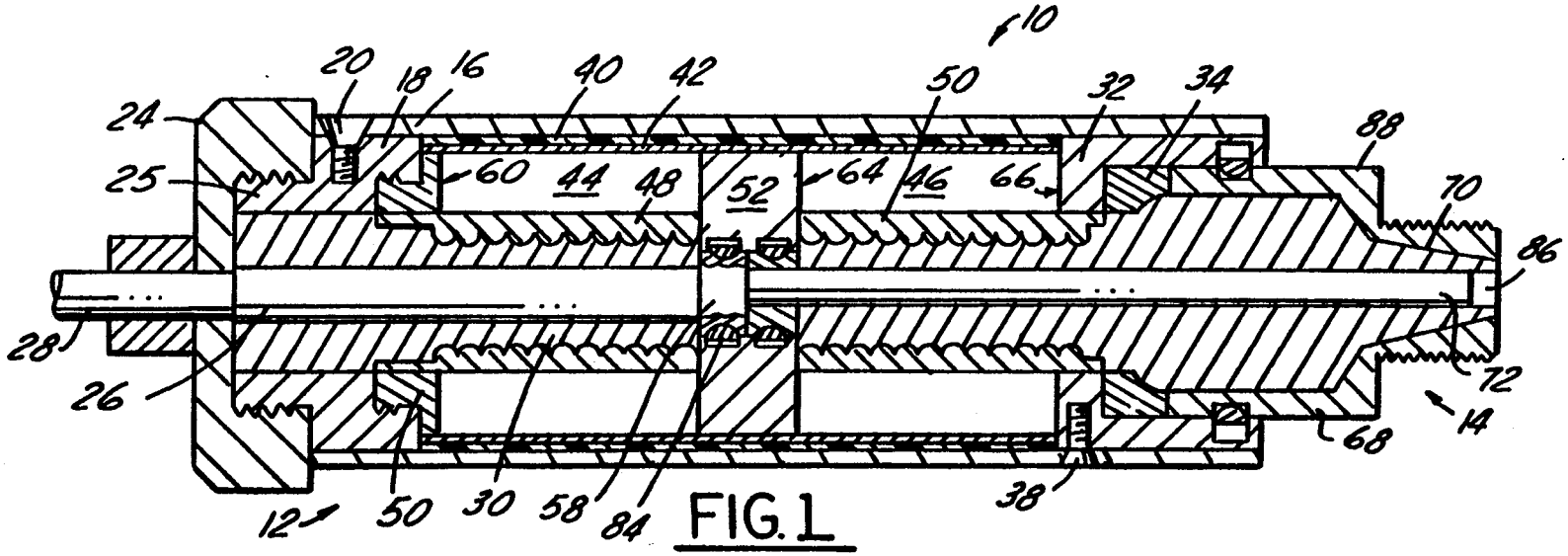
FIG. 1 is a longitudinal view of a combustion ignitor forming a first embodiment of the present invention, parts being broken away in section for clarity.
Figure 4:
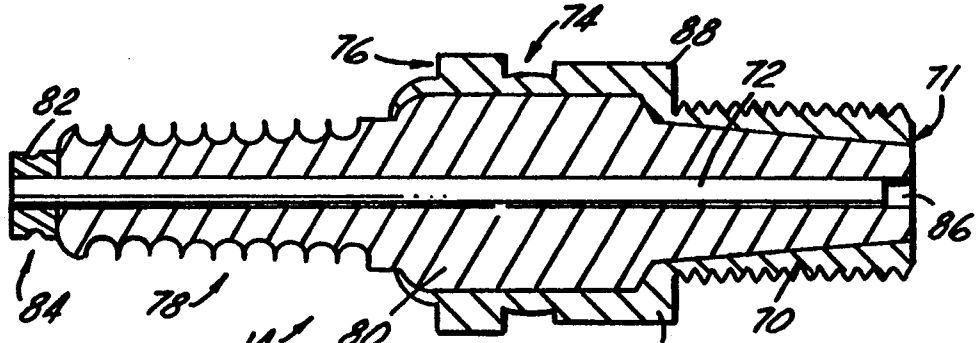
FIG. 4 is a longitudinal view, taken in section, of the electrode portion of the ignitor shown in FIG. 1.
Figure 3:
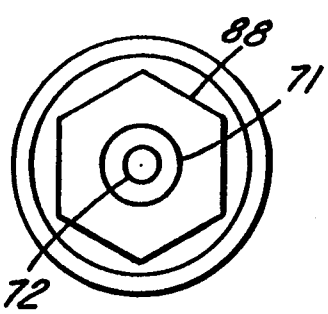
FIG. 3 is a view of the other end of the ignitor shown in FIG. 1.

Referring to the drawings, the present invention relates to a combustion ignitor generally indicated by the numeral 10 in FIG. 1 which is employed to initiate combustion of fuel. The ignitor 10 may be used, for example, to initiate combustion of a fuel-air mixture in an internal combustion engine.

The ignitor 10 includes a body portion 12 adapted to be coupled with a coaxial power supply cable 28, and an electrode portion 14 which in the illustrated embodiment, comprises a conventional, commercially available spark plug which is removably mounted on the body portion 12. The body portion 12 broadly includes a cylindrical, electrically conductive shell 16, an electrically conductive connector assembly 18 and an electrically conductive end assembly 32. The shell 16 may be formed of stainless steel, for example, and the assemblies 18 and 32 may be formed of brass. The assemblies 18 and 32 are respectively secured in the opposite ends of the shell 16 by any suitable means, such as welding or screws 20, 38, and are also respectively secured as by soldering or the like to from mechanical and electrical connections to capacitor plates 60, 62, 64, 66.

The connector assembly 18 includes a threaded neck portion 25 of reduced diameter which threadably receives a connector cap 24. Connector cap 24 is employed to secure the coaxial power supply cable 28 to the ignitor 10. The connector cap 24 connects the outer conductor of the cable 28 with the neck 25 and connects the inner conductor of cable 28 with a later-discussed electrically conductive connecting member 26 which is centrally disposed within the shell 15 and is held in place by a surrounding filler layer 30 of electrically insulative material, such as molded silicone rubber.

A layer or sleeve 40 of high dielectric strength material such as polyamide covers the inside face of the shell 16 and extends between the opposing faces of the connector and end assemblies 18 and 32 respectively. A second layer or sleeve 42 of compliable dielectric potting compound covers the inside face of the plastic sleeve 40.

A cylindrical connector 52, made of brass or other conductive material, is mounted within the shell 16, approximately midway between the assemblies 18, 32, and is electrically insulated from the shell 16 by means of the sleeves 40, 42. The connector 52 is provided with a central aperture and a pair of snap rings 54 and 56 whose purpose will be discussed later.

The connector assembly 18 threadably receives on its inner face an electrically conductive insert 50. The insert 50 circumscribes the connector rod 26 and includes a ring-shaped, transversely extending conducting layer defining an annular capacitor plate 60. Capacitor plate 60 is longitudinally spaced from and extends parallel to a second annular capacitor plate 62. Positioned between the capacitor plates 60, 62 is a ring-shaped, longitudinally extending layer 44 of high dielectric material with a reasonable dielectric constant, such as ceramic, which has a radial width essentially equal to that of plates 60, 62. Plates 60, 62 in combination with the dielectric layer 44 form a capacitor which may be referred to as a discoidal feedthrough capacitor. A second capacitor essentially identical to that just described is formed by capacitor plates 64, 66 and a second layer 46 of high dielectric material.

Two sleeves 48, 50 of compliable dielectric potting compound are respectively provided on the inner face of the above-described capacitors and extend from the connector 52 to and over the edges of assemblies 18 and 32. The inner faces of the sleeves 48, 50 are provided with an undulating surface defined by hills and valleys which function to increase the tracking distance along the surface of an insulator 80 in order to decrease the electric field gradient between plates 60, 62 and 64, 66, and thereby increase the voltage hold-off between such plates. As previously mentioned, a layer 30 of insulating filler material surrounds the connecting member 26 and holds the latter in a central position within the shell 16. The connecting member 26 includes a head 58 provided with a circumferential groove which receives, in snap-fit relation, the snap ring 56. Alternatively, the connector 52 and head 58 may be threadably secured together.

The electrode portion 14 of the ignitor 10 broadly includes an outer metal case 68, a central conductor rod 72 and an insulator 80 which electrically insulates the outer case 68 from the conductor rod 72. One end of the conductor rod 72 is provided with an enlarged head 82 having a circumferential groove 84. The snap ring 54 is received in snap-fit relationship within the groove 84.

The outer case 68 is provided with a circumferential groove 74 within which there is received a second snap ring 36. Snap rings 36 and 54 releasably hold the electrode portion 14 on the body portion 12.

One end 70 of the case 68 is of reduced diameter and is threaded so as to be threadably received within a threaded opening in the cylinder block (not shown) of an internal combustion engine. The outer case 68 is provided with polygonal wrench flats 88 which are adapted to be engaged by a wrench for removing and installing the ignitor 10 in the engine. The outer case 68 is provided with a shoulder 76 which engages a compressible gasket 34 so as to limit the depth of penetration of the electrode portion into the body portion 12 and form a relatively tight seal therebetween.

The insulator 80 may be formed of ceramic or the like and includes a plurality of grooves 78 adjacent one end which are complementarily received within the hills and valleys of the sleeve 50 within the body portion 12. The outer face 71 of the reduced diameter end 70 of the outer case 68 defines an annular electrode, the other electrode being defined by the outer end of the rod 72. The outer end of rod 72 defining the second electrode is recessed at 86 to increase the effective gap length between electrodes. The electrode portion 14 may comprise an essentially conventional spark plug, as mentioned above, except that the grooves 78 are formed therein and the outer end of the rod 72 is recessed somewhat, rather than being flush with the outer end of the insulator 80. However, it is not necessary to recess the rod 72 in this manner, as will become later apparent.

Referring now particularly to FIG. 1 a ground path for current flow between the outer conductor of the coax cable 28 and the outer, annular electrode 71 is defined by the following: cap 24, assembly 18, outer shell 16, end assembly 32, outer case 68. The positive current flow path between the central conductor of the coax cable 28 and the electrode defined on the end of rod 72 is formed by: the connector member 26, connector 52 and rod 72. It may thus be appreciated that capacitor plates 60 and 66 are negative while plates 62 and 64 are positive. In the preferred form of the invention, capacitor plates 60, 62, 64 and 66 are defined by a layer of metallization applied to the ends of the dielectric layers 44, 46 such as silver frit which is fired onto the layers 44, 46 in order to provide intimate physical contact with the dielectric layers 44, 46.

The above-described configuration, in which the capacitive elements are annular in shape and circumscribe the central longitudinal electrode, has been found to be particularly effective in achieving high-voltage hold-off. As will become apparent hereinafter, although two capacitive elements have been disclosed in the illustrated embodiment, only a single such capacitive element may be employed in those application where lower energy levels are required.

Figure 5:
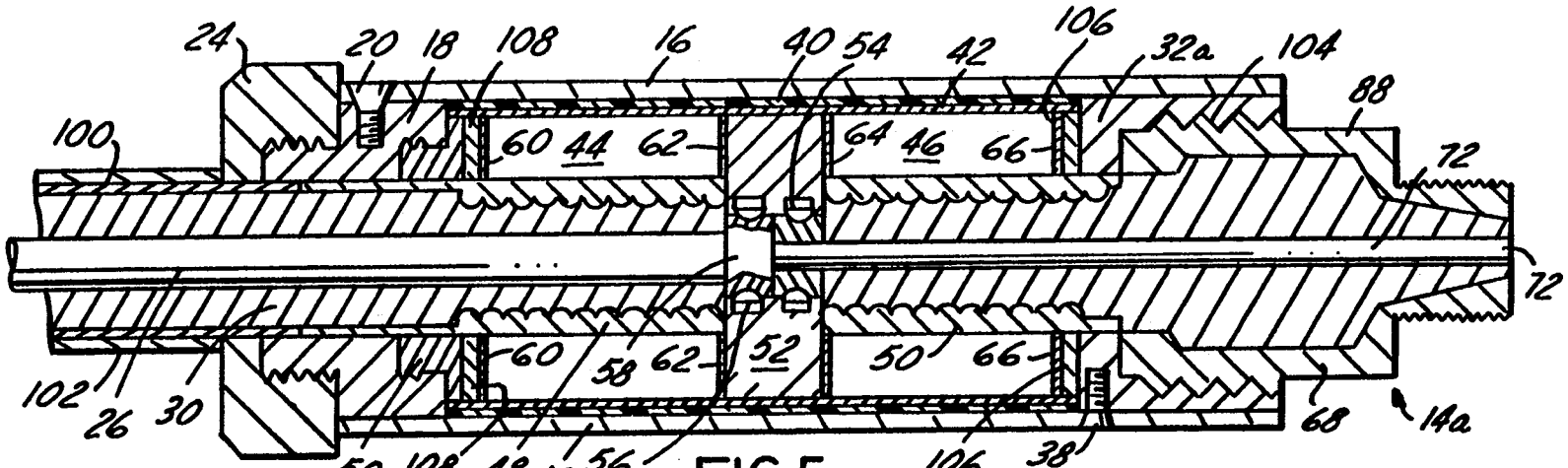
FIG. 5 is a cross-sectional view similar to FIG. 1, but showing a second embodiment of the present invention.

Attention is now directed to FIG. 5 which depicts a second embodiment of the ignitor of the present invention, which is similar in many respects to the ignitor shown in FIG. 1, and accordingly like parts will be designated by the same reference numerals. Further shown in FIG. 5 is the outer conductor 100 which is electrically and mechanically connected to the connector cap 24. The end assembly **32*a* is provided with a threaded inner wall 104 in order to threadably receive the electrodes of 14A which are provided with a threaded outer body 68, as is normally found in a conventional "spark plug." The threads 104 thus function to releasably hold the electrodes 14A within the body portion 12. A further distinguishing feature of the embodiment of FIG. 5 lies in an electrode rod 72 which extends to a point which is flush with the outer end of the outer case 88; thus, in contrast to the recess 86 of the embodiment of FIG. 1, the two outer electrode surfaces of the embodiment of FIG. 5** are flush with each other, i.e. are coplanar.

The embodiment of FIG. 5 is further distinguished by the use of a pair of electrically conductive, flexible connectors 106 and 108 respectively. The flexible connectors 106, 108, which will be described in detail later, are each annular in shape and form a flexible, electrical connection between the dielectric member 44 or 46 and the respectively associated insert 50 or end assembly **32*a*. Flexible connectors 106, 108 are respectively secured to the dielectric members 44, 46 and to end connector 32*a* and insert 50 as by soldering so as to respectively form flexible, electrically conductive connections between the capacitor plates 60, 66 and the insert 50 and end assembly 32*a*. By virtue of the construction of flexible connectors 106, 108, some degree of flexure, for example torsional flexure or bending, is permitted between the dielectric members 44, 46 and the members 32*a*, 50** without breaking the electrical connections of the capacitors formed thereby, as when, by way of example, the ignitor experiences some degree of flexion as a result of torquing it into operative relationship in an engine block or the like or torquing or bending it during the manufacture thereof.

Figure 2:
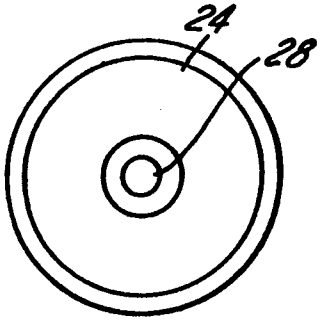
FIG. 2 is a view of one end of the ignitor shown in FIG. 1.
Figure 6:
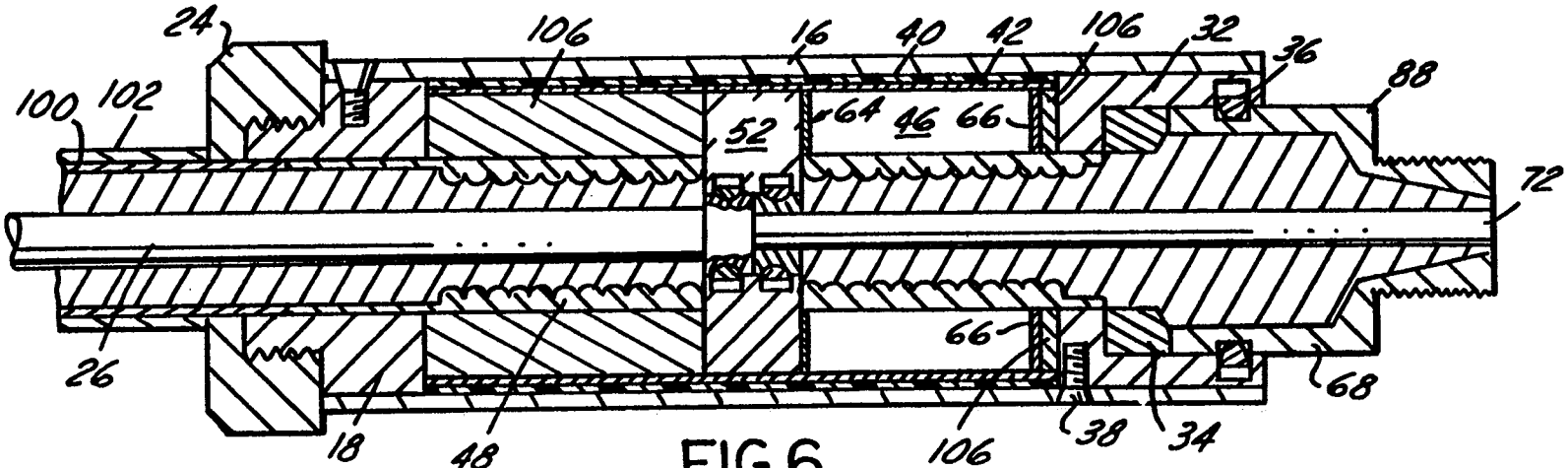
FIG. 6 is a cross-sectional view similar to FIG. 1, but showing a third embodiment of the present invention.

Referring now to FIG. 6, a third embodiment of the present invention is depicted which is generally similar to that shown in FIGS. 1 and 2 but is intended for a lower energy application. Accordingly, rather than employing two capacitive elements as in the embodiments of FIGS. 1 and 5, the embodiment of FIG. 6 employs a single capacitive element defined by the dielectric member 46 and capacitor plates 64 and 66. An insulative insert 106 is provided between the cylindrical connector 52 and the connector assembly 18 to replace the dielectric member 44 of FIG. 5, in order to provide sufficient voltage standoff between the connector 52 and the electric ground defined by the connector assembly 18 and connector cap 24.

Figure 7:
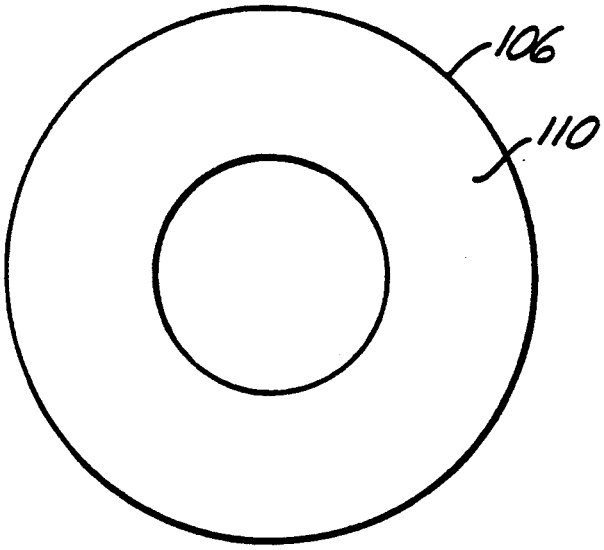
FIG. 7 is an elevational view, taken on an enlarged scale, of one of the flexible connections employed in the embodiments of FIGS. 5 and 6.

FIG. 7 depicts flexible connector 106 in elevation which, incidentally, is identical in construction to flexible connector 108. The flexible connector 106 preferably comprises an inner metal member, as of aluminum, which is substantially solid (but may alternately be hollow) and is covered by an electrically conductive braid or wire mesh 110. The wire mesh 110 completely surrounds the inner metallic member and is in slidable electrical contact therewith. By this arrangement, the faces of the mesh which engage, for example, the capacitor plates 60–66 and the parts 50, **32*a* can remain in stationary contact therewith, while the mesh between these two faces is allowed to bend or twist so as to accommodate relative movement between the plates 60–66 and parts 50, 32*a*** while still maintaining electrical contact therebetween.

Figure 8:
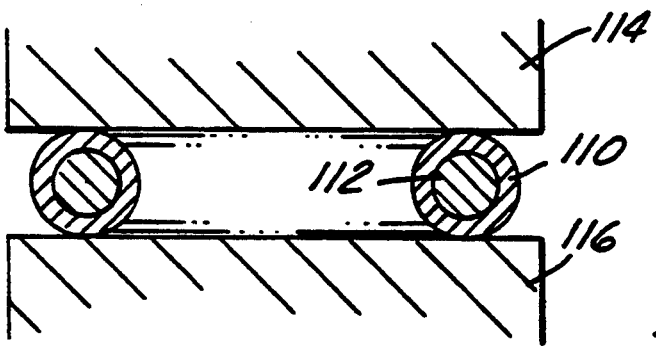
FIG. 8 is a cross-sectional view of the connector of FIG. 7 during an intermediate step of the manufacturing thereof.
Figure 9:
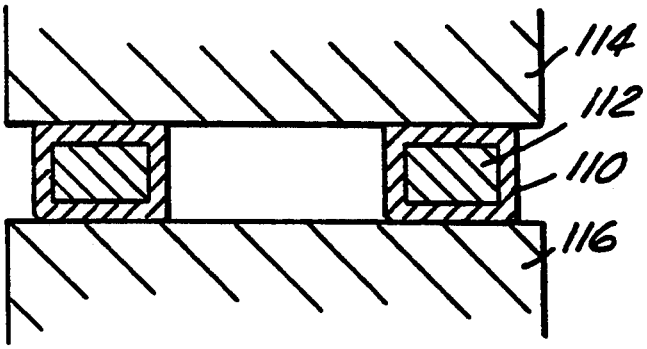
FIG. 9 is a view similar to FIG. 8, but showing the final step in the method of manufacturing the connector of FIG. 7.

A method for making the flexible connector 106 is depicted, in part, in FIGS. 8 and 9. A preferably solid piece of metal rod such as aluminum is formed into an annularly shaped member 112 and is joined at its ends so as to form a closed ring. A layer of conductive metal mesh or braiding 110, preferably a sleeve thereof, is applied over the member 112 and is loosely connected thereto so that the mesh 110 may shift slightly relative to the member 112. Thereafter, the annular member 112 covered by the wire mesh 110 is placed between a pair of press platens 114, 116 and is pressed therebetween until, as shown in FIG. 9, the member 112 and associated wire mesh 110 are compressed or flattened to form two essentially parallel sides or faces which in turn can be sandwiched between one of the dielectric members 44, 46 and the respectively associated connector 32*a*, 50. In FIG. 9, the connector 106 is shown as being compressed into a substantially rectangular shape. It is to be understood that the annular member 112 can either be solid or hollow (ring-shaped in cross-section) and that it is only necessary that the connector 106 be formed into a shape which presents two opposite sides so as to make good electrical contact with both the insulating members 44, 46 and the end connectors 32*a*, 50. In some applications, the member 112 may need not be flattened.

Figure 10:
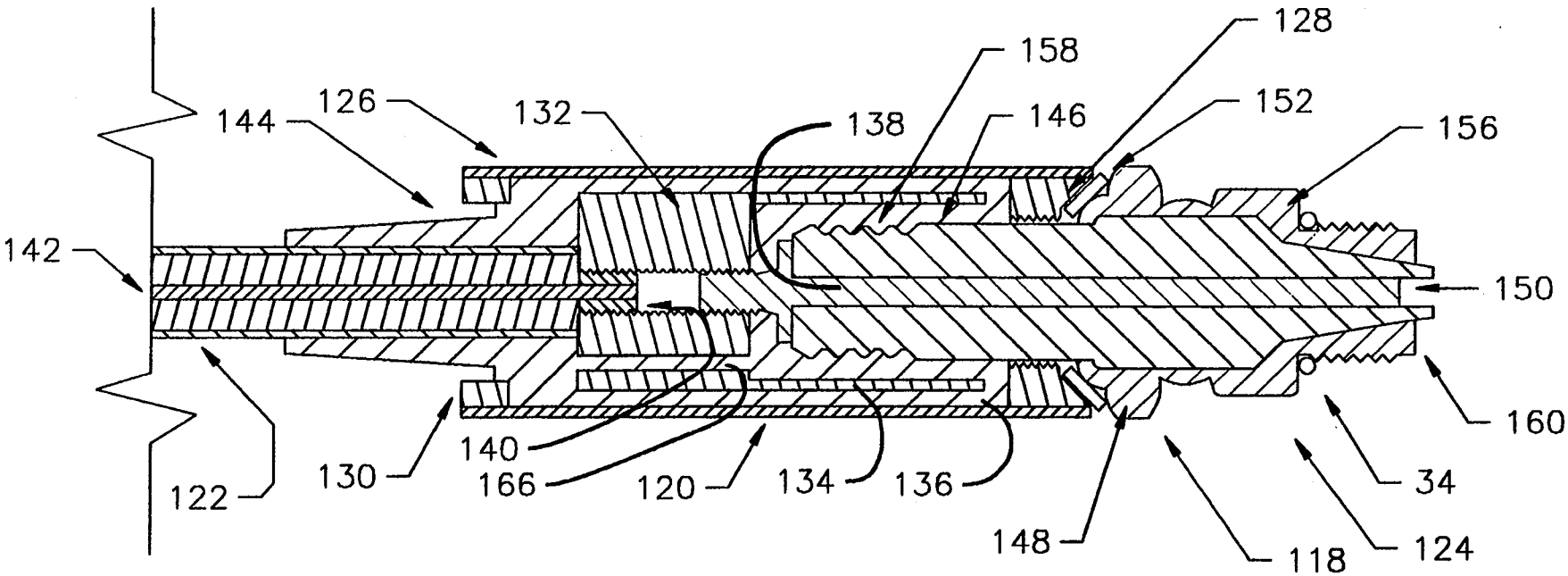
FIG. 10 is a longitudinal, sectional view of an ignitor which forms a fourth embodiment of the present invention.

Attention is now directed to FIG. 10 which depicts an ignitor 118 which forms another embodiment of the present invention. The ignitor 118 includes a body portion 120 coupled with a power supply cable 122 and an electrode portion 124 which, in the illustrated embodiment, comprises a conventional, commercially available spark plug which is removably mounted on the body portion 120. The body portion 120 broadly includes a cylindrical, electrically conductive outer shell or tube 126, an electrically conductive end connector assembly 128 and an end plate assembly 130. The shell 16 and the end connector assembly 128 may be formed, for example, of metal such as brass, steel or aluminum. The end plate assembly 130 may be formed of metal, plastic or the like and need not be electrically conductive in the presently described embodiment. The assemblies 130 and 128 are respectively secured in the opposite ends of the shell 126, as by soldering, press fit assembly or the like to form both mechanical and electrical connections to the shell 16. The shell 126 also forms one outer capacitor plate of a capacitor defined in the body portion 120.

A cylindrical connector portion 132 and attached tubular plate 134 made of brass or other electrically conductive material are mounted within the shell and are concentric with the shell 126. The connector 132 and tubular plate 134 are held in place by a surrounding layer of electrically insulating material 136, such as molded silicone rubber which also forms a capacitive, dielectric material between the capacitor plates defined by the shell 126 and the tubular plate 134. The cylindrical connector 132 has a central threaded aperture which threadably receives a threaded electrically conductive terminal 138 of the spark plug 124, as well as a threaded electrically conductive terminal 140 of the cable 122. The cable terminal 140 is, for example, made of brass or other conductive material and is attached to the power supply cable conductor 142 as by soldering or crimping to provide an electrical connection therebetween. The power supply cable 122 is further secured to the body portion 120 by the electrical insulating material 136 which is also formed around the cable 122 as a cable stress relief 144. The electrically conductive cylindrical shell 126 forms a capacitor plate which extends longitudinally along the length of the body portion and is radially spaced from the inner tubular capacitor plate 134. The inner capacitor plate 134 is centered within the cylindrical shell capacitor plate 126. The capacitive dielectric material 136 is molded in the annulus between capacitor plates 126, 134 and in the surrounding area to form a high dielectric layer which, in conjunction with plates 126, 134, forms a capacitive element for storing electrical energy. The dielectric material 136 is also formed within the shell 126 so as to define a cavity which is configured to conformally receive the electrode insulator portion 146 of the spark plug 124 in a moisture-tight fitting manner to prevent electrical flashover. The spark plug or electrode portion 124 of the ignitor 118 broadly includes an outer metal case 148, a central conductor rod 150 and the insulator 146 which electrically insulates the outer case 148 from the conductor rod 150. One end of the conductor rod 150 is provided with an enlarged terminal head 138 which is circumscribed with threads which are received within the connector 132. A spring metal washer 152 between the shell end connector assembly 128 and the electrode outer metal case 148 is provided to ensure good conductive contact between the electrode metal case 148 and the shell end connector 128, thereby allowing for variations in manufacturing dimensions and tolerances and also allowing some degree of movement during thermal contraction and expansion.

One end 154 of the case 148 is of reduced diameter and is threaded so as to be threadably received within a threaded opening in the cylinder block (not shown) of an internal combustion engine or the like. The outer case 148 is provided with polygonal wrench flats 156 which are employed to be engaged by a wrench for removing or installing the electrode portion 124 in the engine.

The insulator 146 may be formed of ceramic or the like and includes a plurality of grooves 158 adjacent one end thereof which compress and deform the compliable insulator material 136 when received in the body portion 120. The outer end face 160 of the reduced diameter in 154 of the outer case 148 defines an annular electrode. The other electrode is defined by the outer end of the rod 150. The electrode portion 124 may comprise an essentially conventional spark plug, as mentioned above, or other electrode configurations.

With respect to the embodiment disclosed in FIG. 10, a path for electrical current flow between the inner conductor 142 of the supply cable 122 and the inner electrode 150 is defined by terminal 140, assembly 132, inner tubular plate 134, electrode terminal 138 and electrode 150. The other ground current flow path between the outer shell 126 and the outer electrode 160 during discharge is defined by the outer shell 126, assembly 128, connection washer 152, electrode shell 148 and electrode 160. During charge-up of the capacitive portion of the device, the current flow path between the outer shell 126 and the outer electrode 160 is reversed. It may thus be appreciated that the outer shell 16 comprises one capacitor plate and is charged oppositely to the inner assembly 132 and particularly the tubular plate 134 which functions as the other capacitor plate. The dielectric layer 136 is provided in intimate physical contact with capacitor plates 126, 134 to form the capacitive element. As will be discussed below, multiple dielectric materials may also be employed.

The embodiment disclosed in FIG. 10 and described above, wherein the capacitive elements are cylindrical in shape and circumscribe the central longitudinal electrode with a single dielectrical insulating material between the capacitive plates, has been found to be particularly effective in achieving high-voltage hold-off, flexibility in dimensioning and easy to manufacture. As will become apparent hereinafter, although only two capacitor plates have been disclosed in connection with the embodiment shown in FIG. 10, multiple capacitor plates may also be employed in those applications where higher energy levels are required.

Figure 11:
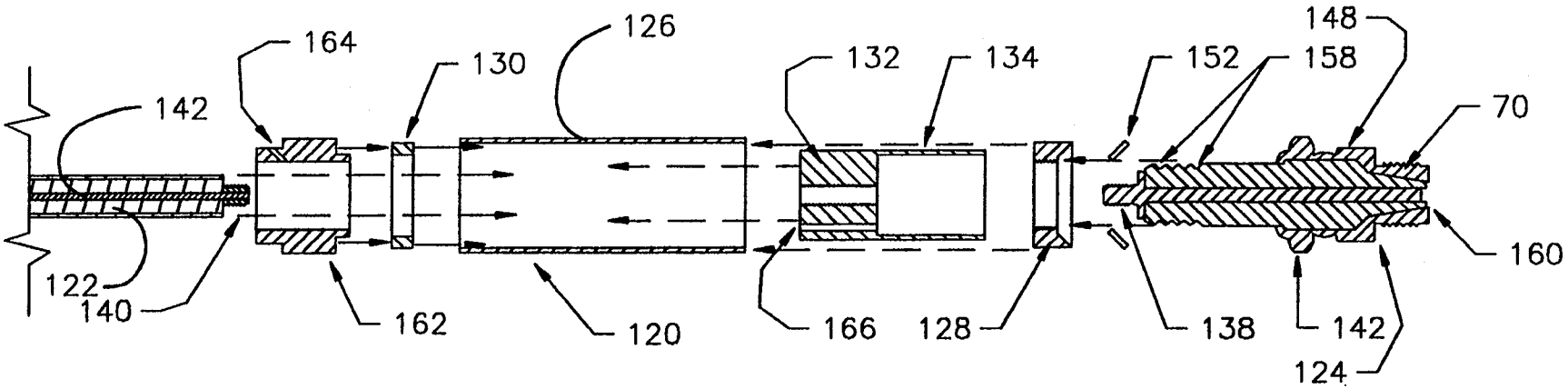
FIG. 11 is a longitudinal, sectional, exploded view of the ignitor of FIG. 10.

FIG. 11 is an exploded view of the ignitor 118 previously described in connection with FIG. 10. FIG. 11 also shows the removable cable stress release form 162 which is used during the manufacturing process to mold the cable stress relief 144. Vent holes 164 and the cable form 162 and 166 in the center connector assembly 132 are provided to allow air to escape and to permit the liquid dielectric material to flow during the impregnation phase of manufacturing, as will be discussed in more detail below. The connection spring washer 158 may be also formed to incorporate a wave structure for purposes which will become later apparent.

Figure 12:
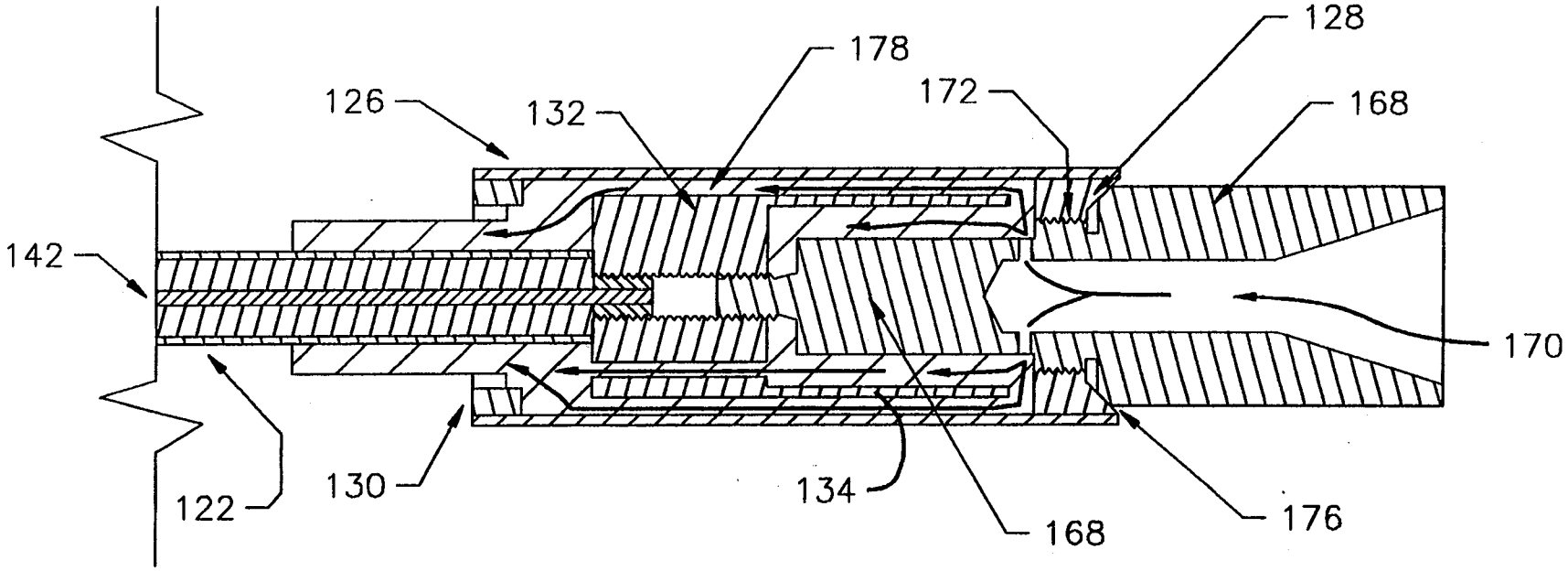
FIG. 12 is a longitudinal, sectional view depicting an intermediate stage in the manufacture of the ignitor of FIG. 10.

FIG. 12 depicts the ignitor 118 during the impregnation phase of the dielectric during the manufacturing process. The dielectric material, in uncured liquid form, is injected under high pressure through a mandrel 168 to bottom fill the ignitor in order to eliminate air voids. While the capacitor 118 is held under vacuum, the injection path 172 of the uncured liquid dielectric 136 is represented by the arrows 170 during the impregnation phase of manufacturing. The vent holes 166 allow the escape of air and the flow of dielectric material to ensure complete impregnation, thereby eliminating voids in the dielectric material when cured. The mandrel 168 is threadably received on the body portion 120 by threads 170 provided on the end connector assembly 128 and is both centered and fixed so as to be parallel to the outer shell 126 by the tapered connection 176. The center connector assembly 132 threadably receives the mandrel top threaded connector 166 which locates the center connector assembly 132 and capacitor plate 134 into the center of the body portion and ensures that the capacitor plate 134 is parallel with the outer shell capacitor plate 126. Multiple dielectric materials may also be incorporated such as epoxy material or polyamide to attain higher dielectric qualities in the annulus 176 between the capacitor plates 126, 134, thereby providing greater capacitance in a given volume. A compliable dielectric compound may be used in conjunction with the above mentioned dielectric or only in the electrode connection area 178 to form the connection portion to the electrode insulator 146, thus providing a good moisture barrier and eliminating electrical flash-over on the electrode insulator 146.

Figure 13:
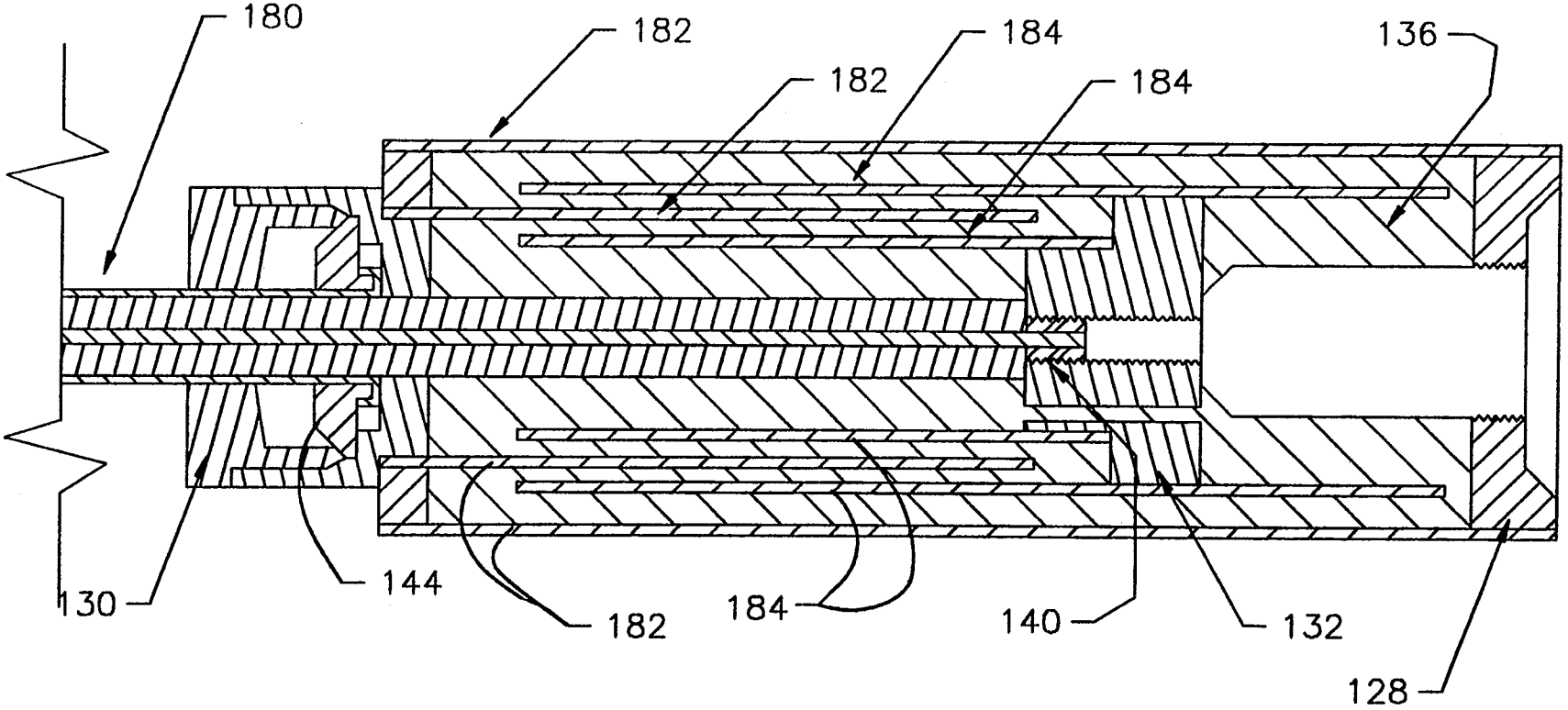
FIG. 13 is a longitudinal, sectional view of an ignitor which forms a fifth embodiment of the present invention, the electrode portion thereof not being shown for purposes of simplicity.

Attention is now directed to FIG. 13 wherein there is depicted still another embodiment of the ignitor of the present invention, which is similar in many respects to the ignitor depicted in FIG. 10, and accordingly some like parts will be designated by the same reference numerals. The power supply cable 180 shown in FIG. 13 is of a coaxial type carrying inner and outer coaxial conductors, which are electrically and mechanically connected to the connector assembly 144 and are threadably secured by the connector cap 130. The coaxial cable 180 may be used in those applications where it is desirable to shield the power supply cable to reduce the amount of radio frequency interference and electromagnetic interference emitted during current flow in the power supply cable conductors. Of further interest in FIG. 13 is the use of two pairs of capacitor plates 182, 184 each in the shape of a tube which are employed in those applications requiring higher energy levels. The capacitor plates 182, 184 form a plurality of capacitors effectively coupled in parallel with each other. The capacitor plates 182 are electrically and mechanically connected at the end connector assembly 130, while the oppositely charged capacitor plates 184 are electrically and mechanically connected at the center connector assembly 186. The capacitor plates 182, 184 may be used in any number to form any desired capacitive level.

Figure 14:
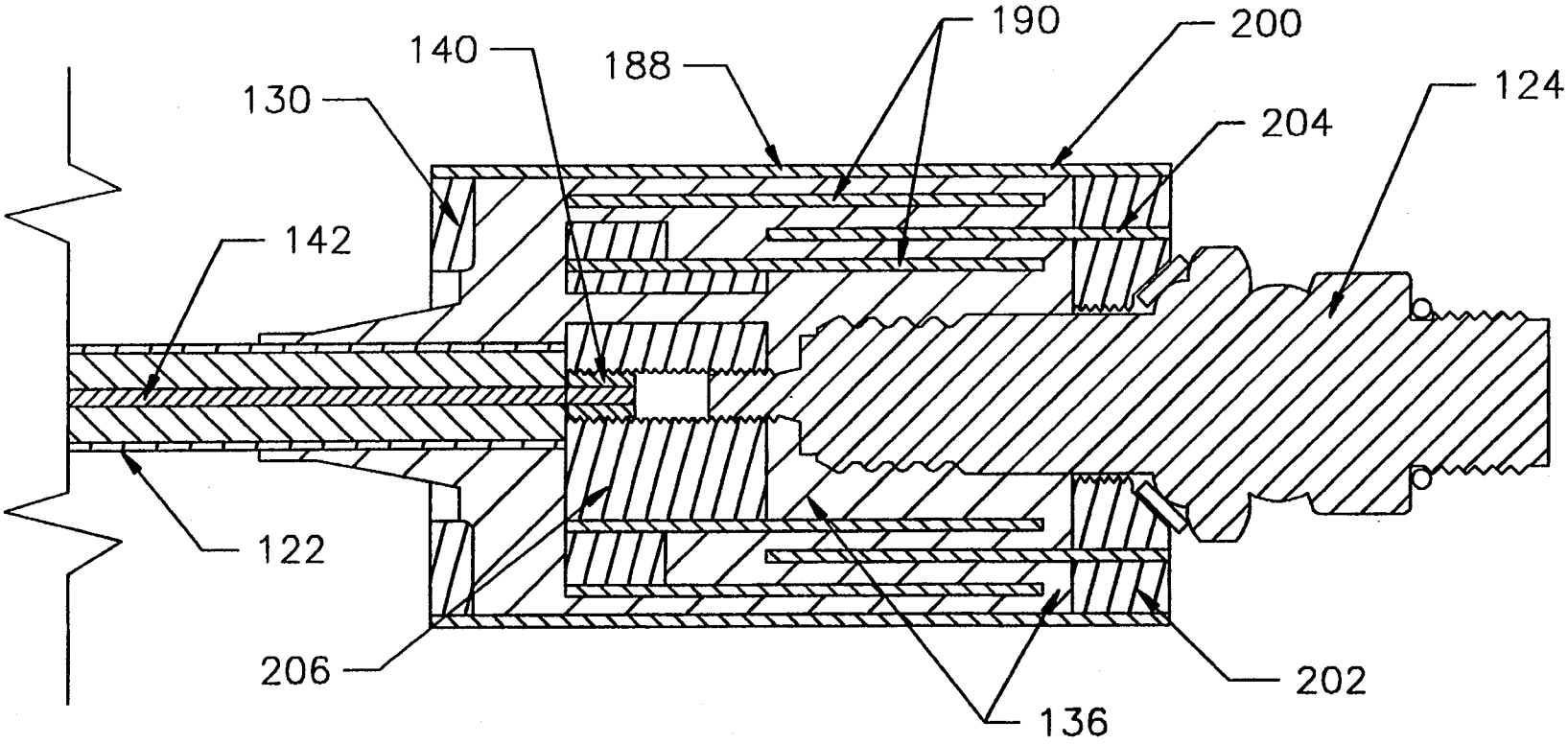
FIG. 14 is a longitudinal, sectional view of an ignitor which forms a sixth embodiment of the present invention, the internal details of the electrode portion thereof not being shown for purposes of simplicity.

Reference is now made to FIG. 14 wherein another alternate embodiment of the ignitor of the present invention is depicted, which is generally similar to that shown in FIG. 13, but is intended for use where longitudinal space is restricted and radial space is available. As in the previous embodiments, the outer shell 188 forms a capacitor plate and is electrically and mechanically connected with the end assembly 202. The end assembly 202 further has a second capacitor plate 200 in the form of a tube connected thereto. The capacitor plates 188, 200 are interleaved with a pair of concentric, tubular capacitor plates 190 which are respectively secured to the connector assembly 206.

Figure 15:
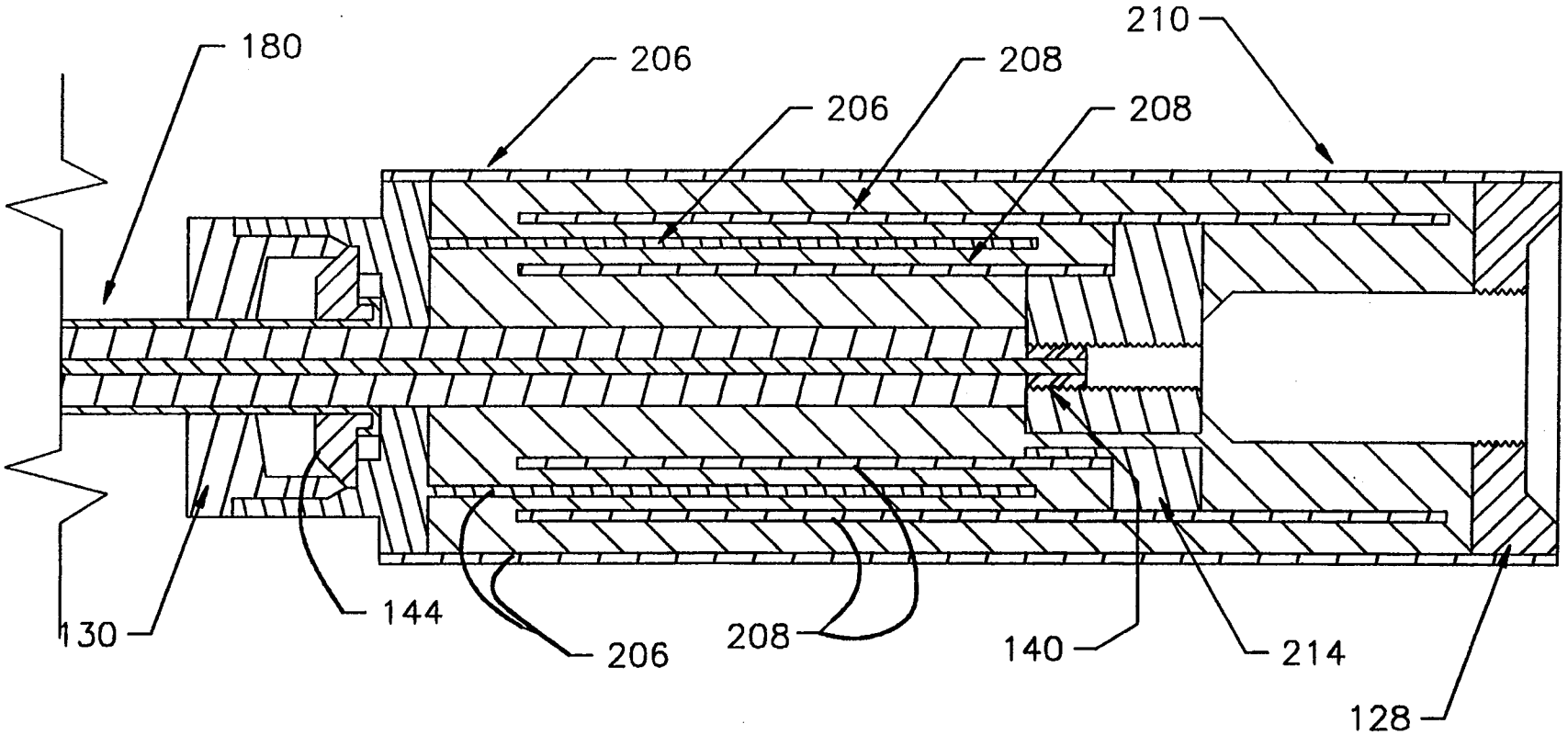
FIG. 15 is a longitudinal, sectional view of an ignitor which forms a seventh embodiment of the present invention, the electrode portion thereof not being shown for purposes of clarity.

FIG. 15 depicts another alternate embodiment of the ignitor of the present invention, wherein the various conducting members, including the two pair of tubular capacitor plates 206, 208, are manufactured from plastic material, as by injection molding, and are subsequently covered with a layer of electrically connective, metallic material 210 as by metallization, to form electrically conductive layers which permit current flow. A metallic insert 212 is employed in the connector assembly in order to form a threaded portion and is made electrically conductive to adjacent metallization.

Figure 16:
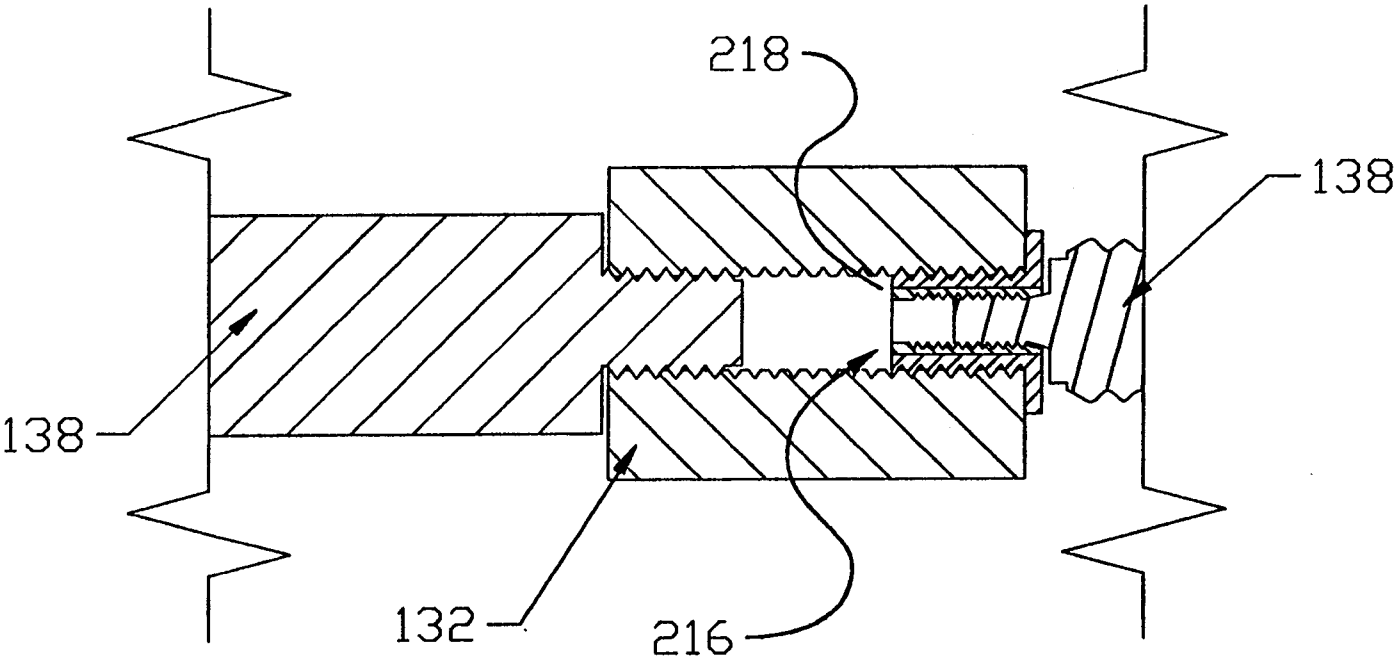
FIGS. 16 and 17 are longitudinal, sectional views respectively depicting two alternate arrangements for electrically and mechanically interconnecting the electrode portion with the body portion of the ignitor of the present invention.

FIG. 16 illustrates an alternative connection arrangement for electrically and mechanically connecting the previously described connector assembly 132 with the electrode connector 138. This alternative connector arrangement allows for connection through direct longitudinal movement, thereby eliminating the need for rotational movement of either the body portion or the electrode portion of the ignitor during installation or removal. A small wire 216 is mounted perpendicular to the insert 218 which is threadably received by the conductor assembly 132 during manufacturing operations. The threaded end terminal of the spark plug electrode 138 is held by friction via the small wire 216 after installation.

Figure 17:
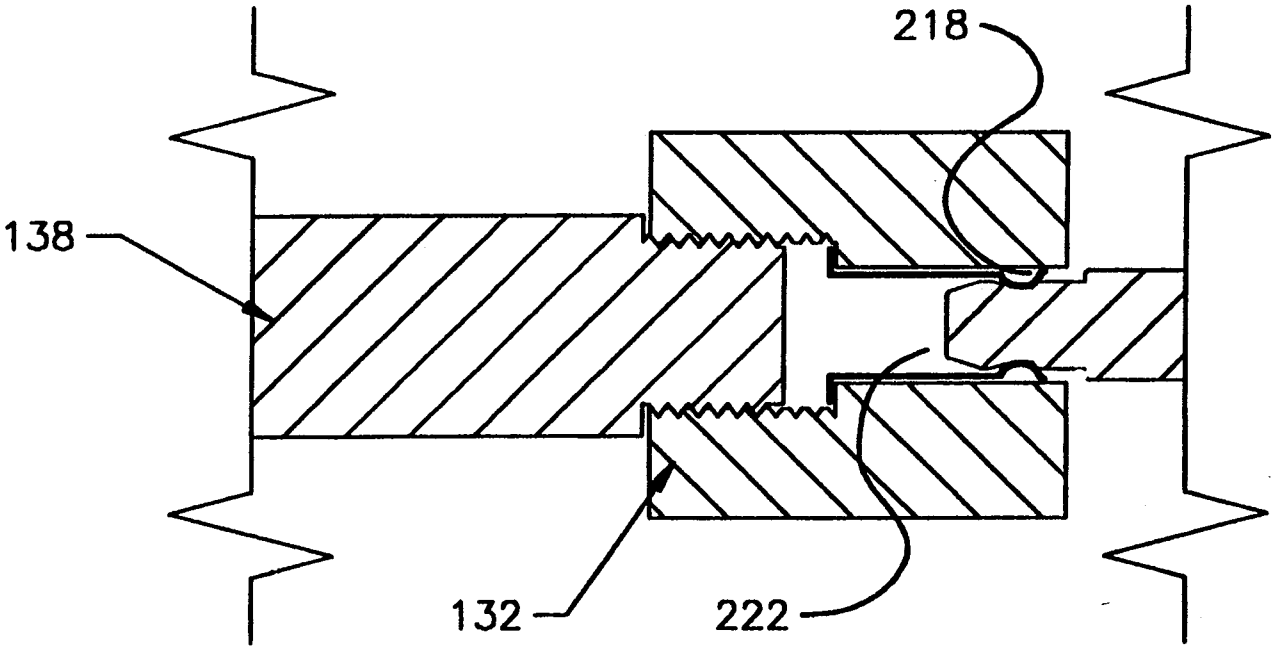

FIG. 17 depicts another alternate means of electrically and mechanically connecting the electrode terminal 138 to the connector assembly 132. A conductive, shaped metal spring 220 is secured in place by cable connecting terminal 140 to allow a snap-type, push/pull connection to a standard-type spark plug connector terminal 222.

Figure 18:
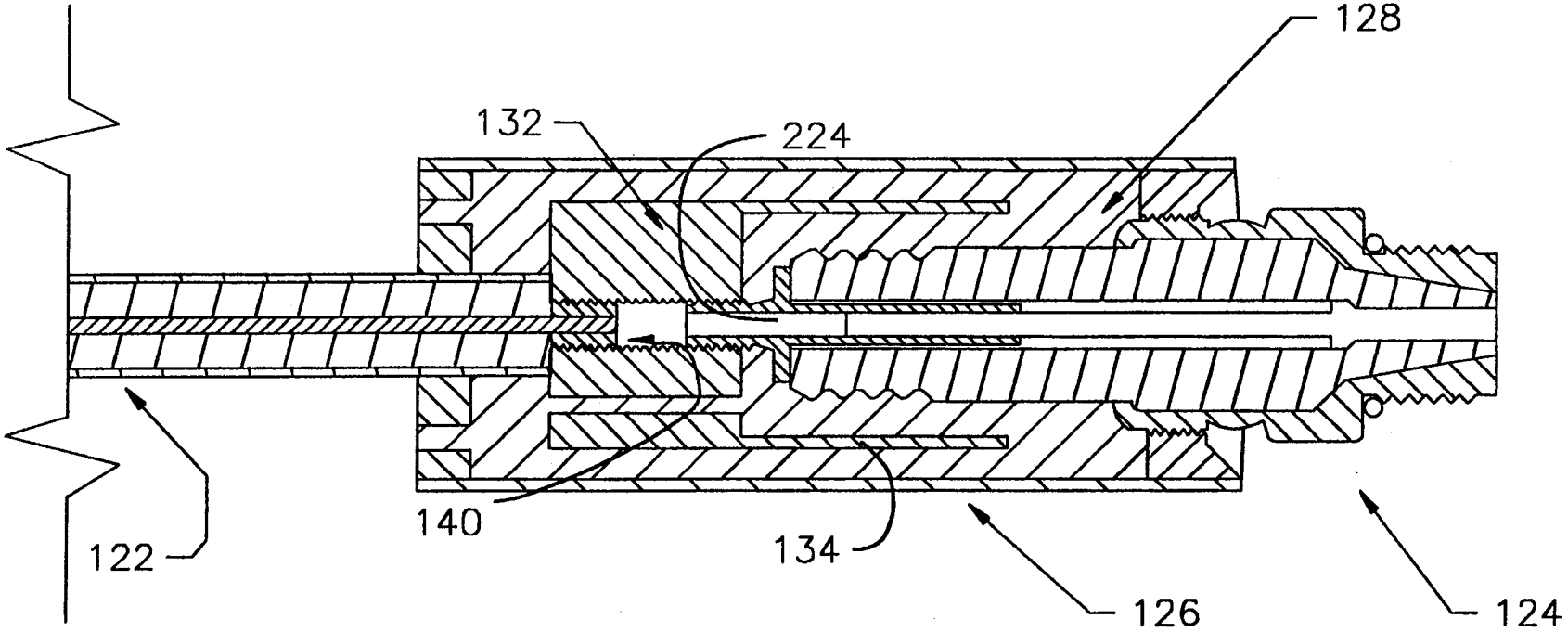
FIG. 18 is a longitudinal, sectional view of an ignitor which forms an eighth embodiment of the present invention.

Referring now to FIG. 18, in a further embodiment of the ignitor of the present invention, the outer electrode casing 148 is threadably connected to the end connector assembly 128 of the body portion 120. A swaged electrical connection is formed by the center connector assembly 132 receiving the split electrode terminal end 224 which is manufactured to incorporate a radial, outward spring force to ensure good electrical connection.

Figure 19:
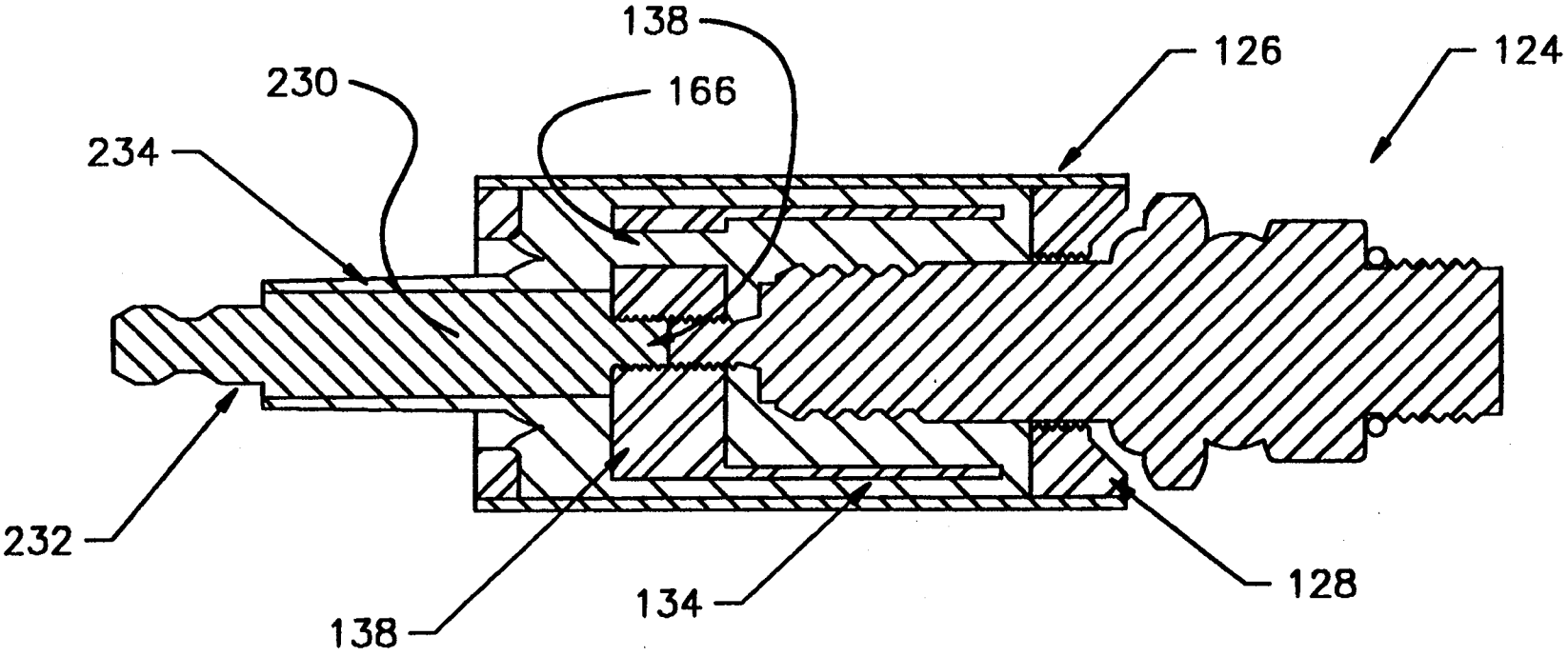
FIG. 19 is a longitudinal, sectional view of an ignitor which forms a tenth embodiment of the present invention, and particularly depicting the details of a removable cable connector.

FIG. 19 depicts another alternate embodiment of the ignitor of the present invention which permits the use of a standard ignition wire and merely requires insertion of the ignitor between the ignition wire and the spark plug. Rather than connecting the power supply cable (not shown) directly to the connector assembly 138, an electrically conductive external terminal 230 is provided, one end of which is threadably received in the connector assembly 138, the other end 232 thereof being configured to provide a snap-fit connection with a standard ignition wire boot. A layer 234 of insulating material extends throughout a substantial portion of the length of the terminal 230.

Figure 20:
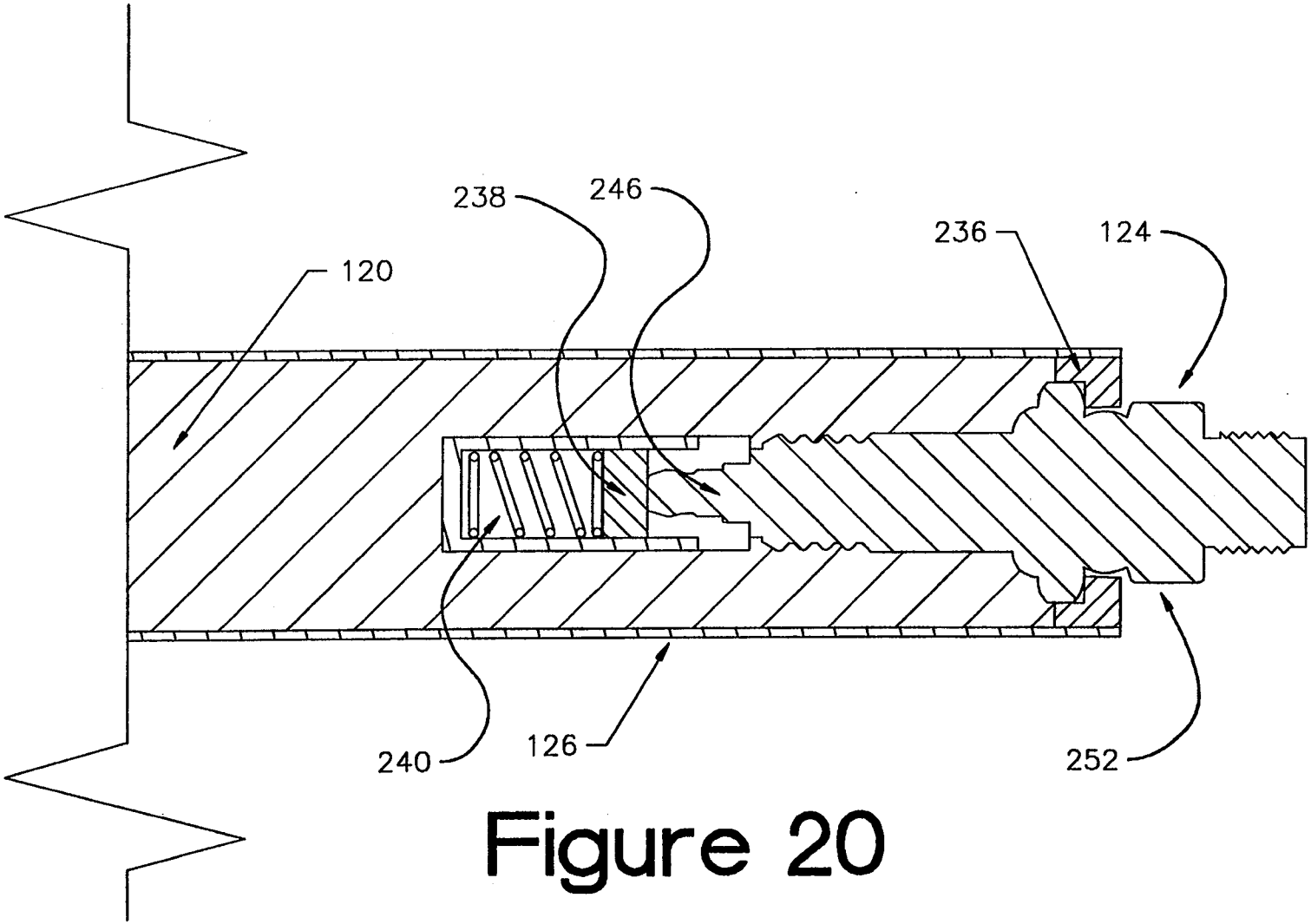
FIG. 20 is a longitudinal view of an ignitor which forms an eleventh embodiment of the present invention, parts being broken away in section for purposes of clarity.
Figure 21:
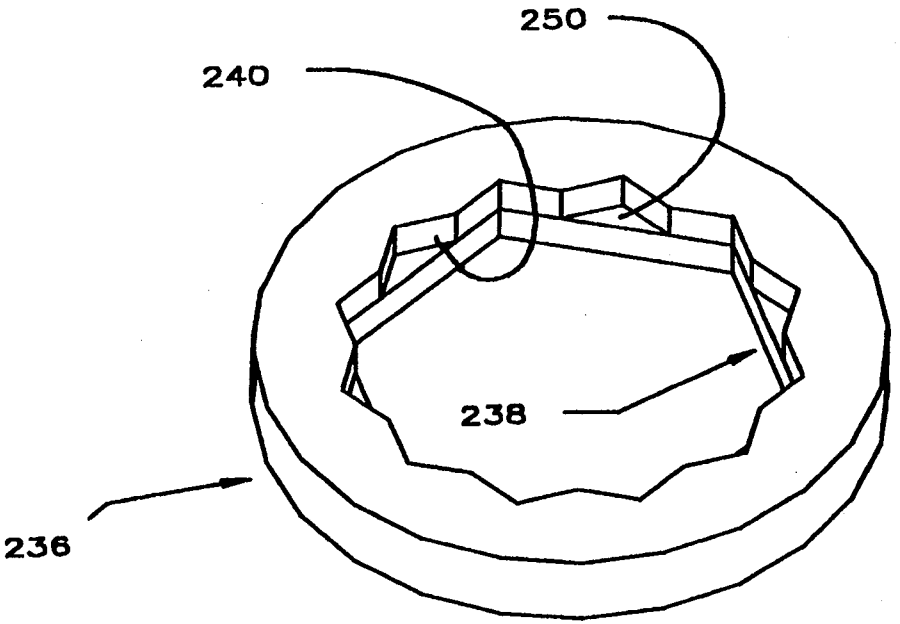
FIG. 21 is a perspective view of a locking ring employed in the ignitor of FIG. 20.

FIG. 20 depicts still another alternate embodiment of the ignitor of the present invention, which incorporates an alternate means of releasably holding the electrode portion or spark plug 124 within the body portion 120 of the ignitor. An electrical connector 238 is biased toward the terminal head 246 of the spark plug 124 by means of a compression spring 240. Secured at the lower end of the shell portion 126 of the body 120 is a retainer ring 236. The retainer ring 236, whose details are depicted in FIG. 21, includes a first hexagonal opening 238 configured to receive the hexagonal wrench flats 248 of the spark plug 124. A second, star-shaped opening 240 overlies the hexagonal opening 238 and is defined by intersecting sides which form shoulders 250 which function to engage and retain a flange 252 on the spark plug 124. The spark plug 124 is installed by passing it through the first hexagonal opening 238 and then twisting it slightly until a portion of the flange 252 at the corner of the hexagonal wrench flats 248 rests upon the shoulder 250.

Having thus described the invention, it is recognized that those skilled in the art may make various modifications or additions to the preferred embodiment chosen to illustrate the invention without departing from the spirit and scope of the present contribution to the art. For example, either more or less than four capacitor plates may be employed to form tile capacitive device. The ignitor may be made such that the electrode portion is non-removable from the body portion containing the capacitor. The various conductors, including the capacitor plates, can be made of any good conducting materials other than brass, for example copper, steel, aluminum or other alloys. The dielectric material employed in the capacitor may be of a polyamide, polyester or other film dielectric impregnated with epoxy, silicone or other potting compounds. The dielectric material may or may not include an impregnate wicking material such as kraft paper, Nomex TM or other fibrous, porous material. The capacitor dielectric material may also simply comprise a potting compound without the use of further materials or may comprise a thermoplastic-type dielectric material. As described above, any of the conductors, including the capacitor plates, may be made from a metal foil or a vapor-deposited metal which does not itself form a structural component of the ignitor.

Accordingly it is to be understood that the protection sought and to be afforded hereby should be deemed to extend to the subject matter claimed and all equivalents thereof fairly within the scope of the invention.

What is claimed is:

1. A device for initiating combustion of fuel in an internal combustion engine, comprising:

a first portion adapted to be connected with an electrical supply cable for supplying electrical energy to said device, said first portion including first and second concentric, spaced apart capacitor plates defining a capacitor for storing electrical energy;

a second portion including a terminal on one end thereof, a pair of electrodes across which electrical energy stored in said capacitor may be discharged and a threaded section on the opposite end thereof for mounting said second portion on said engine; and means for releasably connecting said first portion with said terminal of said second portion to allow replacement of said second portion, at least a section of the length of said first and second capacitor plates surrounding said connecting means and disposed between said connecting means and said opposite end of said second portion.

2. The device of claim 1, wherein said first capacitor plate is cylindrical and defines an outer body of said first portion.

3. The device of claim 2, wherein said second capacitor plate is cylindrical and is disposed within said first capacitor plate, said first portion including a dielectric material disposed between said first and second capacitor plates.

4. The device of claim 3, wherein said second portion includes a conductor disposed within and longitudinally overlapping said first and second capacitor plates.

5. The device of claim 4, wherein said second portion includes an insulative body surrounding said conductor, and said first portion includes a layer of said dielectric material disposed between said insulative body and said second capacitor plate.

6. The device of claim 4, wherein said first portion includes a connector electrically connected with said electrical supply cable and surrounded by said first capacitor plate, said connector being releasably connected with said conductor.

7. The device of claim 6, wherein said second capacitor plate is tubular and said connector is disposed within and is secured to said tubular second capacitor plate.

8. The device of claim 6, wherein said releasable connecting means includes a mating set of threads on said connector and said second portion respectively.

9. The device of claim 1, wherein:

said first portion includes a connector electrically connected with said electrical supply cable, and said releasable connecting means includes mating threads on said connector and said second portion respectively.

10. The device of claim 1, wherein said releasable connecting means includes a pair of mating threads respectively on said first and second portions.

11. The device of claim 1, wherein said electrical supply cable is of a coaxial type having an inner and outer conductor, and said first means further includes means for electrically connecting said outer conductor with said first capacitor plate.

12. The device of claim 1, wherein said first portion includes third and fourth capacitor plates defining said capacitor, said first, second, third and fourth capacitor plates each being cylindrical in shape and being arranged in radially spaced concentric relationship to each other.

13. The device of claim 12, wherein said first capacitor plate forms an outside body of said first portion.

14. The device of claim 12, wherein said first portion includes first and second annular end walls respectively on opposite ends thereof, said electrical supply cable extending through said first end wall sand said second portion extending through said second end wall into said first portion.

15. The device of claim 14, wherein said first and third capacitor plates are electrically connected with one of said end walls, and said second and fourth capacitor plates are electrically connected with said second end wall, and wherein said first and second end walls are formed of electrically conductive materials.

16. The device of claim 15, wherein said first portion includes means for electrically connecting said first end wall with an outer conductor on said electrical supply cable.

17. An ignitor for initiating the combination of a fuel, comprising:

a spark plug portion including a generally elongated body having a pair of spark electrodes on one end thereof;

a boot portion within which the other end of said spark plug portion may be received, said boot portion including capacitive means for storing electrical energy to be delivered to said electrodes, said capacitive means including a pair of radially spaced, cylindrical capacitor plates surrounding and radially spaced from at least a portion of said body; and, electrical connection means for releasably interconnecting said boot portion with said other end of said spark plug portion, said pair of capacitor plates longitudinally overlapping said connection means and including at least a section extending between said connecting means end said one end of said spark plug portion.

18. The ignitor of claim 17, wherein said boot portion includes an electrically conductive exterior shell defining one of said capacitor plates.

19. The ignitor of claim 17, wherein said capacitor plates and the longitudinal axis of said spark plug portion are concentric with each other.

20. The ignitor of claim 17, wherein:

said spark plug portion includes a central conductor and a longitudinally extending insulator surrounding a portion of said conductor, and, at least a portion of said capacitor plates longitudinally overlap at least a portion of said central conductor and said insulator.

21. The ignitor of claim 20, wherein said boot portion includes a layer of dielectric material, said dielectric material extending between said plates and contacting said insulator.

22. The ignitor of claim 17, wherein said connection means is electrically conductive and includes an opening therein within which the other end of said spark plug portion is received so as to form an electrical connection between said other end and a supply of electrical energy.

23. The ignitor of claim 22, wherein said boot portion includes a dielectric material portion substantially surrounding and holding said connection means end extending between said plates.

24. The ignitor of claim 17, wherein said connection means includes threads on said boot portion and said spark plug portion.

25. A combustion ignitor comprising:

an electrode partially disposed within and protruding from said ignitor;

a first electrically conductive tube containing a portion of said electrode;

an electrically conductive plate positioned in close proximity to said first electrically conductive tube;

a second electrically conductive tube containing said first electrically conductive tube and said electrically conductive plate;

an electrically conductive outer shell containing said electrode, said first electrically conductive tube, said electrically conductive plate, and said second electrically conductive tube; and dielectric means disposed between said electrode and said first electrically conductive tube, between said first electrically conductive tube and said electrically conductive plate, between said electrically conductive plate and said second electrically conductive tube, and between said second electrically conductive tube and said electrically conductive outer shell in order to allow the combination of said first electrically conductive tube, said electrically conductive plate, said second electrically conductive tube, and said electrically conductive outer shell to receive and store energy and to transfer said stored energy to said electrode.

26. The ignitor of claim 25 wherein said electrically conductive plate comprises a plastic body substantially enclosed by a layer of electrically conductive metallic material.

27. A device for initiating combustion of fuel in an internal combustion engine, comprising:

a first portion adapted to be connected with an electrical supply cable for supplying electrical energy to said device, said first portion including first and second concentric, spaced apart capacitor plates defining a capacitor for storing electrical energy;

a second portion including a pair of electrodes across which electrical energy stored in said capacitor may be discharged and a threaded section for mounting said second portion on said engine; and, means for releasably connecting said first portion with said second portion to allow replacement of said second portion, said first capacitor plate being cylindrical and defining an outer body of said first portion, said second capacitor plate being cylindrical and disposed within said first capacitor plate, said first portion including a dielectric material disposed between said first and second capacitor plates, said second portion including a conductor disposed within and longitudinally overlapping said first and second capacitor plates, said first portion including a connector assembly electrically connected with said electrical supply cable and surrounded by said first capacitor plate, said connector being releasably connected with said conductor, said second capacitor plate being tubular and wherein said connector is disposed within and is secured to said tubular second capacitor plate.

28. A device for initiating combustion of fuel in an internal combustion engine, comprising:

a first portion adapted to be connected with an electrical supply cable for supplying electrical energy to said device, said first portion including first and second concentric, spaced apart capacitor plate defining a capacitor for storing electrical energy;

a second portion including a pair of electrodes across which electrical energy stored in said capacitor may be discharged and a threaded section for mounting said second portion on said engine; and, means for releasably connecting said first portion with said second portion to allow replacement of said second portion, said first portion including third and fourth capacitor plates defining said capacitor, said first, second, third and fourth capacitor plates each being cylindrical in shape and being arranged in radially spaced, concentric relationship to each other, said first portion including first and second annular and walls respectively on opposite ends thereof, said electrical supply cable extending through said first end wall and said second portion extending through said second end wall into said first portion.

29. An ignitor for initiating the combustion of a fuel, comprising:

a spark plug portion including a generally elongated body having a pair of spark electrodes on one end thereof; and, a boot portion within which the other end of said spark plug portion may be received, said boot portion including capacitive means for storing electrical energy to be delivered to said electrodes, said capacitive means including a pair of radially spaced, cylindrical capacitor plates surrounding and radially spaced from at least a portion of said body, said boot portion including connector means for connecting the other end of said spark plug portion with a supply of electrical energy, one of said capacitor plates surrounding and being secured to said connector means.

* * * * *